United States Patent [19]

Gomes

[11] 4,351,524

[45] Sep. 28, 1982

[54] SWING

[76] Inventor: Daniel Gomes, 104½ E. Kirkwood, Apt. B, Bloomington, Ind. 47601

[21] Appl. No.: 168,198

[22] Filed: Jul. 10, 1980

[51] Int. Cl.[3] ..... A63G 9/00

[52] U.S. Cl. ..... 272/85; 297/280; 297/184; 297/160; 248/188

[58] Field of Search ..... 272/85, 75, 86, 87, 272/88, 89, 90, 91, 92; 297/273-280

[56] References Cited

U.S. PATENT DOCUMENTS

| | | | |
|---|---|---|---|
| 303,551 | 8/1884 | Arnold | 272/88 |
| 358,701 | 3/1887 | Shepardson | 297/276 |
| 427,900 | 5/1890 | Pearson | 272/85 |
| 491,172 | 2/1893 | Hart | 297/279 |
| 580,076 | 4/1897 | Wohler | 297/278 |
| 664,933 | 1/1901 | Durnell | 297/277 |
| 787,556 | 4/1905 | Bottager | 297/279 |
| 953,591 | 3/1910 | Bringham | 297/279 |
| 1,173,654 | 2/1916 | Eaton | 297/277 |

FOREIGN PATENT DOCUMENTS

| | | | |
|---|---|---|---|
| 227054 | 1/1925 | United Kingdom | 297/274 |
| 899008 | 6/1962 | United Kingdom | 272/85 |
| 708277 | 6/1966 | United Kingdom | 272/85 |
| 1286716 | 8/1972 | United Kingdom | 297/274 |

*Primary Examiner*—Richard C. Pinkham

*Assistant Examiner*—T. Brown

*Attorney, Agent, or Firm*—Jenkins, Coffey, Hyland, Badger & Conard

[57] ABSTRACT

A swing according to the present invention includes a pair of side frame members, a sling forming at least one seat well and seat back, a first suspension system for supporting the sling from the side frame members and for adjusting the depth of the seat well and the length of the seat back, and a second suspension system for pivotally supporting the side frame members from an overhead support structure and for adjusting the inclination of the side frame members to recline the seat assembly. The second suspension system includes a pair of elongated support strands, each having its ends connected to one of the side frame members, a pair of pulleys, each for rotatably receiving one of the strands, and adjustment blocks movably carried on each strand for establishing strand lengths between the side frame members and the pulleys to raise and lower the ends of the side frame members and maintain a desired angle of inclination thereof. The swing is suspendable from an overhead support stand which, according to the present invention, includes a cross bar having hollow ends, four elongated columns, each having at least one hollow end, and two corner braces for removably joining the ends of the cross bar to the leg columns.

15 Claims, 10 Drawing Figures

SWING

The present invention relates in general to swings and swing assemblies and is more particularly concerned with improvements in the assembly and structure of swings which increase versatility by allowing them to be easily adjusted for various individuals and which decrease assembly time by eliminating the need for tools.

Many swing types and varieties, each having different assemblies and structures, are well known to those familiar with swings. In general, a swing structure which is assembled for sitting or resting includes a seat suspended by ropes or chains from an overhead support structure which swings freely to and fro on the support structure. Most conventional swings are designed so that they must utilize specially manufactured parts. Typically, these parts are difficult to assemble and require various tools for assembly. Furthermore, most swing structures, when disassembled, cannot be compactly packaged for transportion from one location to another.

Another disadvantage of conventional swing assemblies is that they cannot be easily converted from a single-seat swing to a multiple-seat swing or vice versa. In other words, they lack versatility.

It is therefore one object of the present invention to provide a swing assembly which is versatile, lightweight, compact, portable, and easy to assemble, requiring no tools for assembly. The swing assembly may be stored in two compact packages, each having a combined length and girth of less than 108 inches and each weighing less than 50 pounds.

It is a further object of the present invention to provide a swing assembly which will accommodate either a single or multiple seat construction and which can easily be converted from one to the other construction. Accessories for the swing may include materials and components to convert the swing assembly from a single-seat swing to a multiple-seat swing or vice versa.

According to the present invention, a swing includes a frame, means for supporting a seat assembly from the frame, and suspension means for pivotally supporting the frame from an overhead support structure and for adjusting the inclination of the frame to recline the seat assembly, the suspension means including a pair of support strands connected to the frame on both sides of the seat assembly, a pair of pulleys each rotatably receiving one of the strands to allow movement of the strands, and adjustment blocks movably carried on each strand for establishing strand lengths between the pulleys and the frame to raise and lower portions of the frame and maintain a desired angle of inclination thereof.

In one illustrative embodiment, the seat assembly includes a sling forming at least one seat well and seat back, the means for supporting the seat assembly from the frame includes first and second elongated bars connected to opposed sides of the sling for engaging the frame, the frame includes two elongated side members for supporting the sling therebetween, and means for variably positioning each of the first and second elongated bars in at least two different positions relative to the ends of the side members to adjustably vary the depth of the seat well and the length of the seat back.

In a further illustrative embodiment of the present invention, the swing includes at least one armrest, the armrest includes an arcuate section having a shape generally the same as the seat well cross-sectional contour, means for pivotally connecting the armrest to one of the side members, and means for adjusting the elevation and angle of inclination of the armrest relative to the seat assembly. Further, the swing includes a table surface having support means for removably and movably engaging the armrest wherein the support means includes a channel for frictionally engaging the top of the armrest to allow the table surface to be slidably moved away from and toward the seat assembly along the armrest.

Various other features and advantages of the present invention will become apparent in view of the following detailed description of one embodiment thereof, which description should be considered in view of the drawings in which.

and

Figure 9:
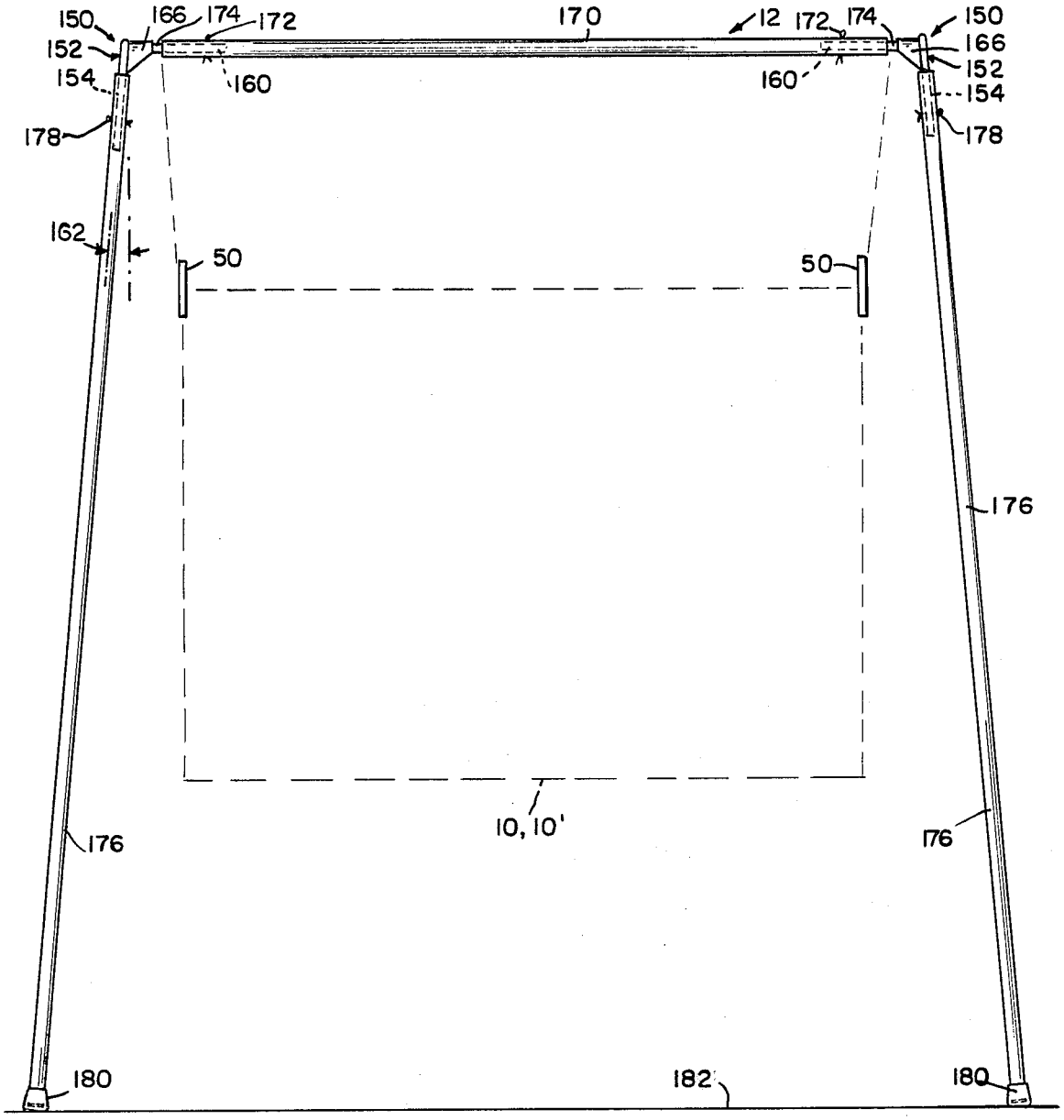
FIG. 9 is a front or rear plan view of an overhead support stand according to the present invention for suspending the swings shown in FIGS. 1 and 2 therefrom.
Figure 10:
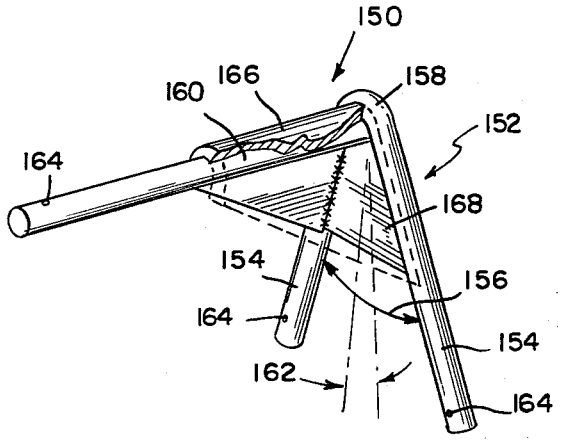

FIG. 10 is a sectional view, partly cross-sectioned, of the overhead support stand shown in FIG. 9.

Figure 1:
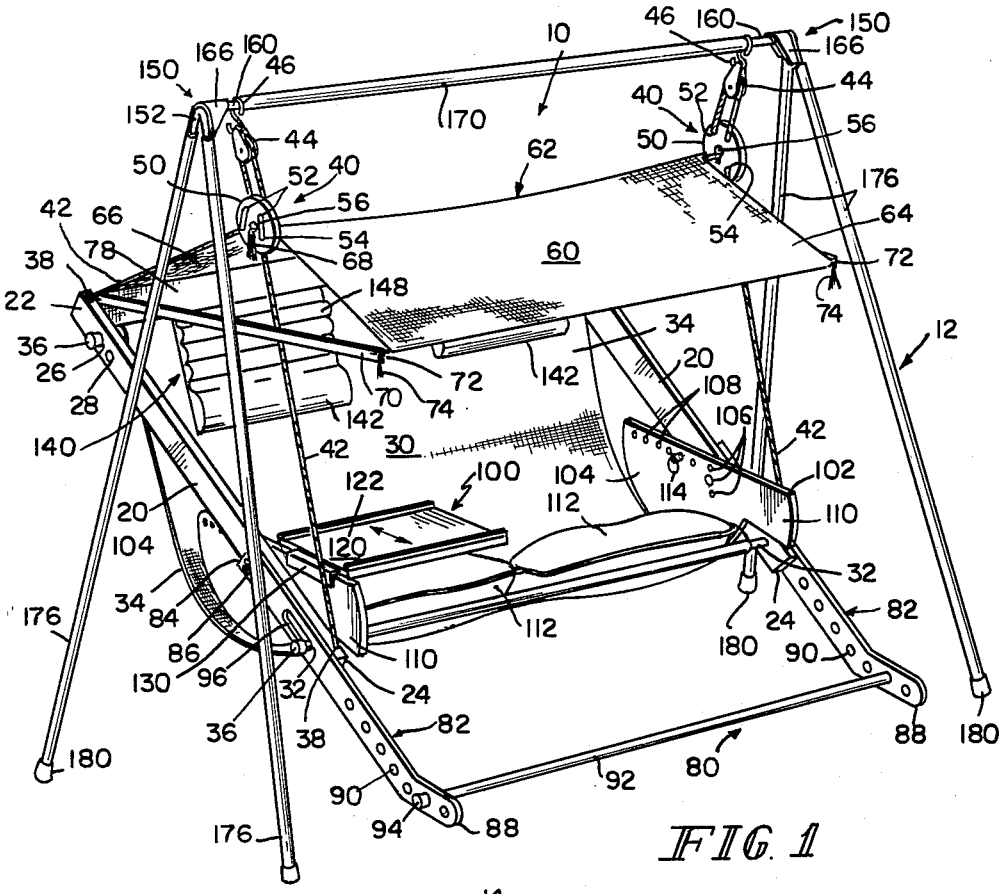
FIG. 1 is a perspective view of a double-seat swing and overhead support stand constructed according to the present invention.
Figure 2:
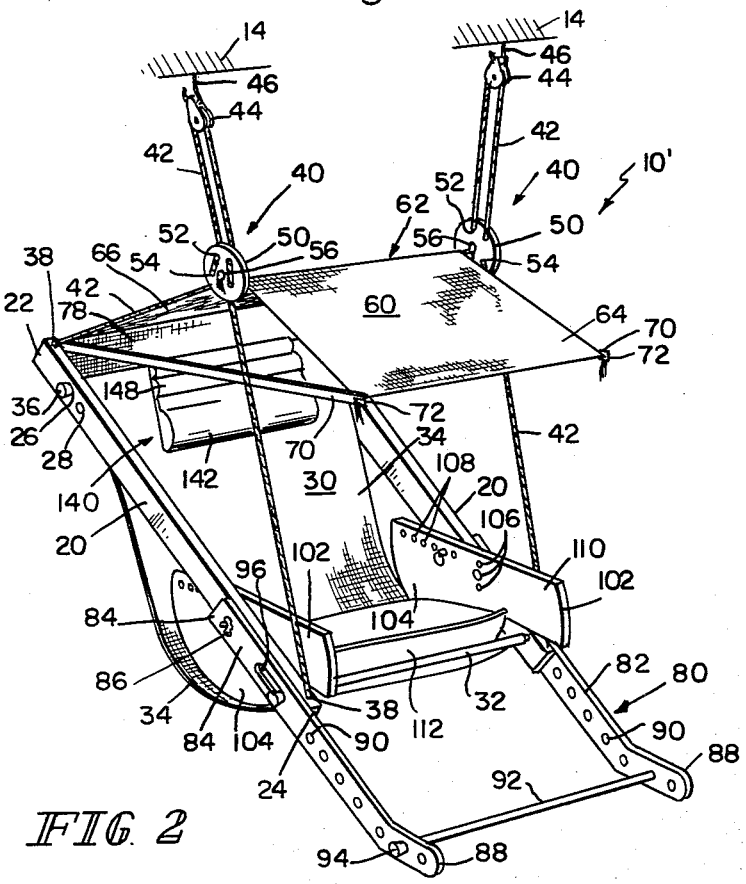
FIG. 2 is a perspective view of a single-seat swing according to the present invention shown suspended from an overhead support structure.
Figure 3:
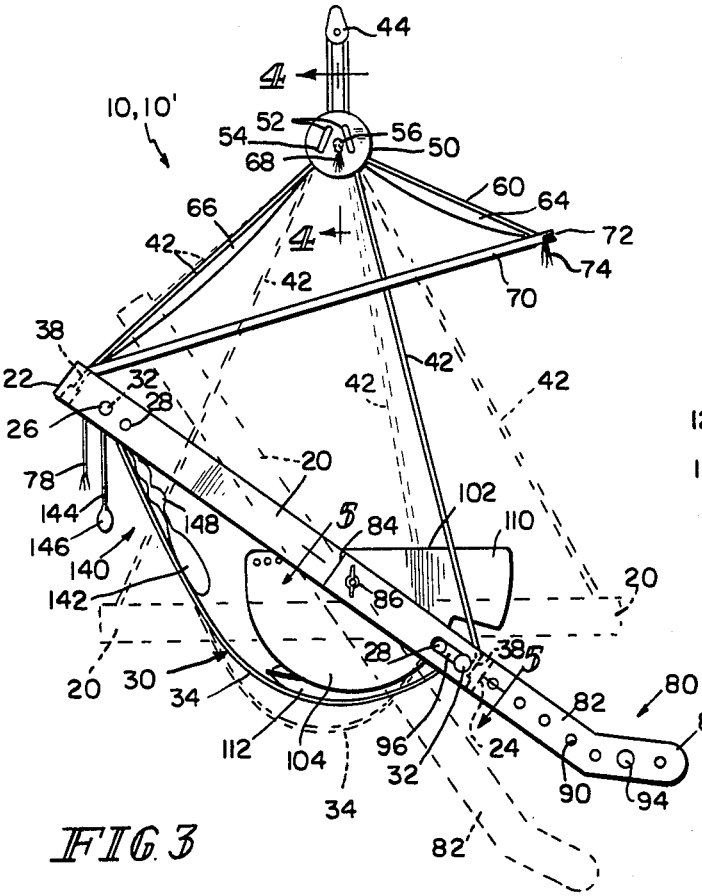
FIG. 3 is a side plan view of a swing according to the present invention illustrating various reclining positions thereof.

Referring now to FIGS. 1, 2, and 3, one of the unique features associated with the swing assembly of the present invention is its structural design which allows the components of the assembly to be manufactured utilizing available materials and unsophisticated manufacturing equipment, and which is also capable of producing either a double-seat swing 10 (see FIG. 1) or a single-seat swing 10' (see FIG. 2). Either one of the swings 10, 10' according to the present invention is capable of being suspended from either a movable overhead stand 12 or a stationary overhead support structure 14 such as a ceiling, exposed-beam or tree-limb. It is important to note that except for the dimensions of certain components of the swings 10, 10', the double-seat swing 10 and the single-seat swing 10' include the same components and are identically constructed. Accordingly, FIG. 3 is illustrative of both the double-seat swing 10 and the single-seat swing 10' and the same reference numerals have been utilized to indicate the same components of both the double-seat swing 10 and the single-seat swing 10′ in FIGS. 1 and 2, respectively. Unless otherwise indicated hereinafter, components of both the double-seat swing 10 (FIG. 1) and the single-seat swing 10′ (FIG. 2) which are identified by the same reference numerals also have the same dimensions.

Continuing to refer to FIGS. 1, 2, and 3, a swing 10, 10′ according to the present invention includes two wooden side frame members 20 having ends 22, 24. In one illustrative embodiment, the side frame members 20 are cut from readily available two-inch by four-inch poplar. Formed in proximity to each of the ends 22, 24 of each of the side frame members 20 are two apertures 26, 28 which provide means for adjustably suspending a seat assembly 30 therebetween in various positions.

The seat assembly 30 includes two elongated support bars 32 which are connected to opposed sides or ends of a canvas sling 34. In one illustrative embodiment, the support bars are constructed of galvanized steel pipe. It should be noted that the width of the canvas sling 34 and the length of the support bars 32 will be different for the double-seat swing 10 and the single-seat swing 10′. One of the support bars 32 is inserted into one of the apertures 26, 28 in proximity to the ends 22 of each of the side frame members 20 and the other support bar 32 is inserted into one of the apertures 26, 28 in proximity to the ends 24 of each of the side frame members 20 so that the canvas sling 34 is suspended between the side frame members 20. Rubber caps 36 are placed over the ends of the support bars 32 to hold the bars 32 in place and also to provide protection against bumps and scratches from the ends of the bars 32.

When suspended between the side frame members 20, the fabric sling 34 forms one or two seat wells and one or two seat backs associated with the seat wells. Each of the support bars 32 is variably supported by the side frame members 20 in one of two possible positions so that the canvas sling 34 may be adjusted to vary the depth of the seat well and the length of the seat back. The apertures 26, 28 in proximity to the ends 22 of the side frame members 20 allow the length of the seat back of the fabric sling 34 to be adjusted for a tall or short individual, and the apertures 26, 28 in proximity to the ends 24 of the side frame members 20 allow the depth of the seat well to also be adjusted for individuals of various sizes. As can best be seen in FIG. 3, when the lower support bar 32 is inserted into apertures 26 in proximity to ends 24 of the side frame members 20, the depth of the seat well is decreased, as indicated by the solid lines representing sling 34. When the lower support bar 32 is inserted into the aperture 28 in proximity to ends 24 of the side frame members 20, the depth of the seat well is increased, as indicated by the broken lines representing sling 34.

The side frame members 20 also each include in proximity to their respective ends 22, 24 apertures 38 which are countersunk at the bottom thereof for connecting the side frame members 20 to an adjustable swing suspension assembly 40. The swing suspension assembly 40 includes two elongated support strands 42, each having its ends connected to the opposite ends 22, 24 of a side frame member 20, utilizing the apertures 38. In one illustrated embodiment, the support strands 42 are manilla rope. Each support strand 42 is looped over a rotatable pulley 44 so that the strand 42 is easily movable to raise and lower the ends 22, 24 of the side frame members 20. Each of the pulleys 44 includes an eye for receiving a hook 46 which can be used to engage the overhead support structure 12, 14, and suspend the swing 10, 10′ therefrom. In addition to allowing freedom of movement of the support strands 42, the pulleys 44 also provide a fulcrum point for pivotal to-and-fro motion of the swing 10, 10′ with a minimum of friction. The minimization of friction during the motion of the swing 10, 10′ reduces wear on the support strands 42 and allows the swing 10, 10′ to move for a longer period of time with a reduced amount of effort.

Figure 4:
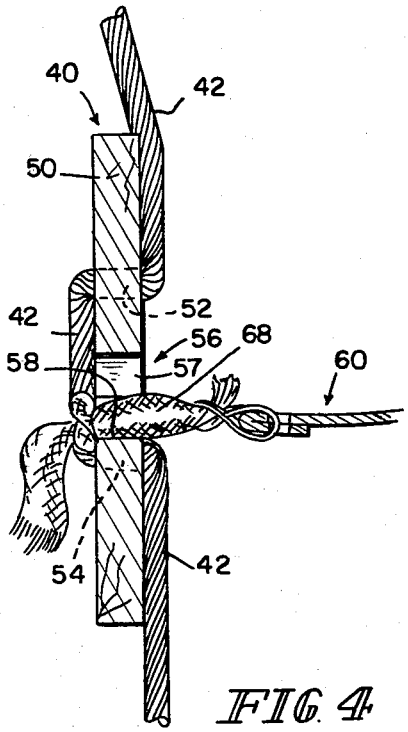
FIG. 4 is a fragmentary cross-sectional view of the swing shown in FIG. 3, taken generally along section lines 4—4 of FIG. 3.

Referring more particularly to FIG. 4, each of the support strands 42 carries a circular adjusting block 50, each having two lengths of a support strand 42 threaded therethrough to adjust the angle of inclination of the side frame members 20 and recline the seat assembly 30. Adjustment of the reclining position of the seat assembly 30 is achieved by varying the lengths of the support strand 42 between the pulley 44 and the ends 22, 24 of the side frame member 20. The combination of the rotatable pulleys 44 and the movable adjusting blocks 50 allow the ends 22, 24 of the side frame members 20 to be raised and lowered to adjust the angle of inclination of the side frame members 20, as best illustrated by the broken lines shown in FIG. 3. By adjusting the angle of inclination of the side frame members 20, the reclining angle of the seat assembly 30 is also adjusted to provide either a more erect or a more reclined seat assembly 30.

Either of the adjusting blocks 50 include two spaced-apart upper apertures 52 and two spaced-apart lower apertures 54, each of which are positioned radially from the center of the circular block 50. It should be noted that the lower apertures 54 are spaced further apart from each other than the upper apertures 52 and that the distances between upper and lower apertures 52, 54 are the same for each pair thereof so that intersecting lines connecting the apertures 52, 54 would form an isosceles triangle. Located centrally to the circular adjusting block 50 is another aperture 56 having a keyhole shape. The aperture 56 includes a cylindrical portion 57 and a radially outwardly extending slot 58, as best illustrated in FIG. 4. In a manner to be described hereinafter, the keyhole-shaped slot 56 provides means for quickly and easily attaching and tensioning a canopy assembly 60 suspended above the seat assembly 30.

Continuing to refer to FIG. 4, the support strands 42 are threaded through the upper and lower apertures 52, 54 of the adjusting blocks 50 so that once the adjusting blocks 50 are moved along the support strands 42 and the lengths of the support strands 42 between the pulleys 44 and the ends 22, 24 of the side frame members 20 are established, the weight of the swing assembly and tension of the support strands 42 in combination with the adjusting blocks 50 fix the lengths of the support strands 42 to maintain the desired angle of inclination of the side frame members 20.

Returning to FIGS. 1, 2, and 3, the canopy assembly includes a rectangular canvas cover 62 which is divided into a front section 64 and a rear section 66. It should be noted that the width of the canvas cover 62 will be different, depending upon whether the canopy assembly 60 is being used with a double-seat swing 10 (FIG. 1) or a single-seat swing 10′ (FIG. 2). Attached to the side edges of the canvas cover 62 and providing a division between the front section 64 and the rear section 66 are two opposed side ties 68. The ties 68 are inserted through the keyhole-shaped apertures 56 in the adjusting blocks 50 and retained in the apertures 56 by knots formed in the distal ends of the ties 68.

The swing 10, 10′ is designed to be suspended from two overhead support points which, for a double-seat swing 10, are located fifty-six inches apart and, for a single-seat swing 10′, are located thirty-two inches apart. These distances between the overhead support points have been specifically selected to cause the support strands 42 to pull the adjusting blocks 50 in opposed directions and provide necessary tension on the canvas cover 62 to hold the canopy assembly 60 taut above the seat assembly 30.

The canopy assembly 60 further includes two side canopy support members 70, each having slotted ends 72 to support the front section 64 of the canvas cover 62 above the seat assembly 30. The front section 64 includes two front ties 74 which are attached to the corners of the front section 64 and which engage one of the slotted ends 72 of each of the canopy support members 70. The rear section 66 includes two rear ties 76 which are attached to the sides of the canvas cover 62 in spaced relationship to the corners of the rear section 66. In one embodiment, the rear ties 76 are attached to the rear section 66 approximately seven inches from the corners of the rear section 76. These rear ties 76 are in turn attached to the support strands 42 in proximity to the ends 22 of the side frame members 20, and they also engage the other slotted ends 72 of the canopy support members 70 to support the front section 64 above the seat assembly 30. Since the rear ties 76 are attached in spaced relationship to the corners of the rear section 66, the rear section 66 also forms a rear wind flap 78, as best illustrated in FIG. 3, which freely hangs at the rear of the swing 10, 10′ to allow gusts of wind to pass through the swing 10, 10′. This feature reduces the effect on the swing 10, 10′ of wind being captured in the cavity formed by the seat assembly 30 and canopy assembly 60. It should be noted that the two canopy support members 70 may be easily removed and the front section 64 folded back so that the seat assembly 30 is partially exposed from above.

Continuing to refer to FIGS. 1, 2, and 3, the swing 10, 10′ also includes an adjustable footrest assembly 80. The footrest assembly 80 includes side support members 82 which extend downwardly from the outside of the side frame members 20 in parallel relationship thereto. The side support members 82 include a first end 84 connected to the side frame members 20 by a carriage bolt and wing nut 86 and an upwardly angled second end 88. The second end 88 is angled upwardly so that the swing 10, 10′ may be suspended close to the floor or ground surface. For example, the second end 88 can clear the floor by about five or six inches, and the swing 10, 10′ will operate without hitting the floor in its to-and-fro motion. This also allows for easier entry and exit from the seat assembly 30. Extending from the second end 88 longitudinally along the side support members 82 is a series of circular apertures 90 for variably supporting or holding a foot bar 92. Each of the circular apertures 90 represent a different position for the foot bar 92 so that the footrest assembly 80 is variably adjustable for various sizes of individuals using the swing 10, 10′. Rubber caps 94 are provided on the ends of the foot bar 92 to hold the bar 92 within the apertures 90 and also to provide protection against bumps and scratches from the ends of the foot bar 92.

Formed in the side support members 82 of the footrest assembly 80 in proximity to the first ends 84 are elongated longitudinal slots 96 which, when the side support members 82 are connected to the side frame members 20, coincide with the apertures 26, 28 located in proximity to end 24 of the side frame members 20. These slots 96 engage the lower support bar 32 for the seat sling 34 and therefore add support to the side support members 82. Further, the slots 96 allow the lower support bar 32 of the seat sling 34 to be adjusted in either one of the apertures 26, 28 without removing the side support members 82.

Figure 7:
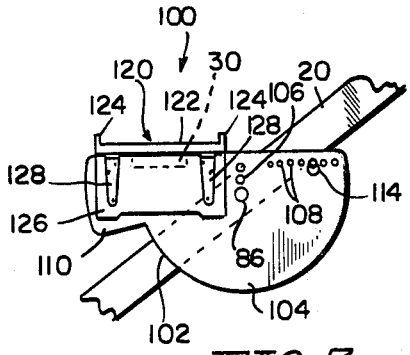
FIG. 7 is a diagrammatic sectional view of the portion of the swings shown in FIG. 6 illustrating one position thereof in relation to the swing assemblies of FIGS. 1 and 2.
Figure 8:
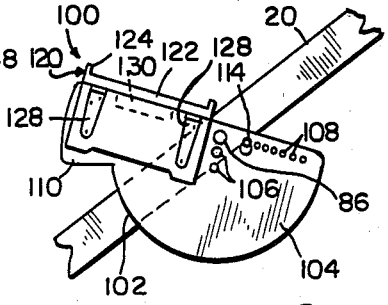
FIG. 8 is a diagrammatic sectional view of the portion of the swings shown in FIGS. 6 and 7 illustrating a tilted position thereof in relation to the swing assemblies of FIGS. 1 and 2.
Figure 6:
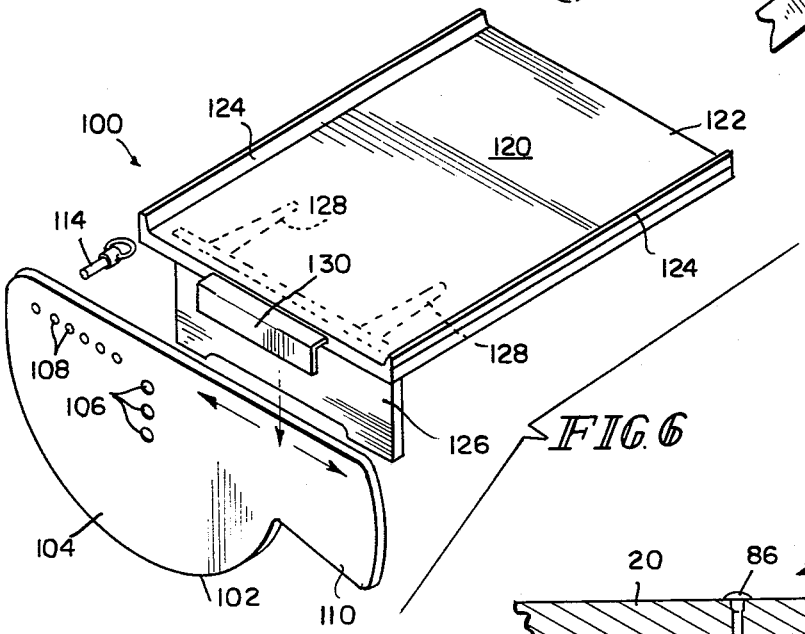
FIG. 6 is an exploded perspective view of a portion of the swings shown in FIGS. 1 and 2.
Figure 5:
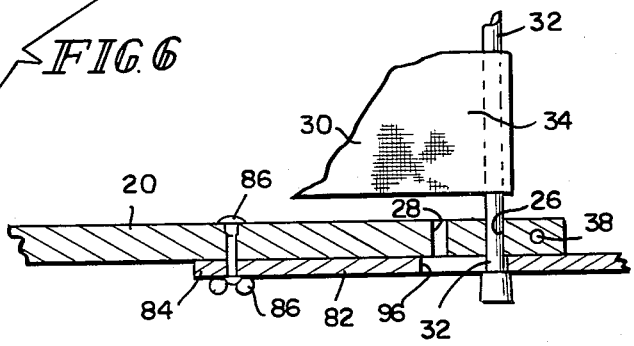
FIG. 5 is a fragmentary cross-sectional view of the swing shown in FIG. 3, taken generally along section lines 5—5 of FIG. 3.

Referring now to FIGS. 6, 7, and 8, the swing 10, 10′ according to the present invention further includes an adjustable arm and table assembly 100. The arm and table assembly 100 includes two armrests 102 which are adjustably connected to the inside of the side frame members 20 using the same carriage bolt and wing nut 86 which also secures the side support members 82 of the footrest assembly 80 to the side frame members 20. The armrests 102 each include a generally semicircular section 104 having generally the same curvature as the cross-sectional contour of the seat sling 34 so that when the armrests 102 are connected to the side frame members 20, the semicircular sections 104 provide side panels to the seat assembly 30 to prevent items from falling off the ends of the seat sling 34. Formed in the semicircular section 104 of the armrest 102 is a series of vertical apertures 106 which are used for adjusting the elevation of the armrests 102 relative to the seat assembly 30. Also formed in the semicircular section 104 of each armrest 102 is a series of horizontal apertures 108 which are employed to tilt the armrest 102 and adjust the angle of inclination of the armrest 102 relative to the seat assembly 30. The armrests 102 also include a flared section 110 protruding outwardly from the semicircular section 104. As can best be seen in FIG. 3, the shape of the armrests 102 has been specifically designed to hold items such as seat cushions 112 in the sling 34 of the seat assembly 30 by preventing them from sliding out the sides of the sling 34.

Referring more particularly to FIGS. 7 and 8, the armrests 102 are each provided with a removable pin 114 for engaging the series of horizontal apertures 108. When the pin 114 is inserted through one of the horizontal apertures 108, it engages the bottom surface of the side frame member 20 to hold the armrest 102 in a tilted position at a desired angle of inclination relative to the seat assembly 30. For example, in FIG. 7, the armrest 102 is shown in a generally horizontal position relative to the seat assembly 30. In FIG. 8, the armrest 102 is shown in a tilted position relative to the seat assembly 30 at a fixed angle of inclination relative thereto. As will be explained in more detail hereinafter, tables 120 are removably supported by the armrest 102 and are therefore also tiltable at various angles of inclination relative to the seat assembly 30 for purposes of reading, writing, or drawing.

Referring particularly to FIG. 6, a removable table 120 according to the present invention is frictionally supported by an armrest 102. The table 120 includes a planar table surface 122 having front and rear upwardly projecting flanges 124 positioned at its edges to prevent items such as books, pencils, etc., from rolling off of the table surface 122. Attached in spaced relationship inwardly from one edge of the table surface 122 is a downwardly extending inner side panel 126. In one embodiment, the inner side panel 126 is connected to the table surface 122 five-eighths inch from the edge of the table surface 122 which generally corresponds to the thickness of the armrest 102. The inner side panel 126 is connected to the table surface 122 by two L-shaped brackets 128 which are in turn connected to the bottom of the table surface 122. Connected to the same edge of the table surface 122 in spaced relationship to the inner side panels 126 is an angle iron 130 which projects downwardly to form an outer side channel between the angle iron 130 and the inner side panel 126. The channel formed by the space between the inner side panel 126 and the angle iron 130 is employed to engage the upper edge of an armrest 102 and hold the table surface 122 on the armrest by frictional contact therewith. Accordingly, the table surface 122 will slide along the upper edge of the arm rest 102 so that it is movable toward and away from the seat assembly 30 and may also be easily removed from the armrest 102 to allow individuals to enter and exit the seat assembly 30. However, once the table surface 122 is positioned in the desired location on the armrest 102, the frictional contact therebetween is sufficient to prevent the table surface 122 from moving without some force being applied thereto.

Referring again to FIGS. 1, 2, and 3, the swing 10, 10′ further includes a rear cushion 140 which is adjustable for head or back support. The rear cushion 140 has an elongated rectangular shape and drapes over the upper support bar 32 for the seat sling 34, and is held in position by frictional contact between the cushion 140 and the fabric material of the seat sling 34. One end of the cushion 140 includes an enlarged cushioned pillow 142, and the other end of the cushion 140 includes an elongated flap 144 having a counterweight 146 provided in the end thereof to counterbalance the cushioned pillow 142 and prevent the cushion 140 from slipping on the seat sling 34. Formed in proximity to the enlarged cushion pillow 142 is a series of cushioned ribs 148 which are designed to provide protection and cushion for the head of an individual when the enlarged cushioned pillow 142 is placed at the nape of the individual's neck. It can be appreciated that the cushion 140 may be adjusted to various heights along the seat back of the seat assembly 30 to accommodate individuals of various sizes who use the swing 10, 10′.

Turning now to FIGS. 9 and 10, there is shown an overhead support stand 12 according to the present invention for supporting a swing 10, 10′. The overhead support stand 12 includes two corner braces 150 which removably support and join a cross bar 170 and four elongated leg columns 176 to form the overhead support stand 12. The construction of the two corner braces 150 is best illustrated in FIG. 10. Each corner brace 150 includes a first bar or member 152 which has been bent so that it has a generally inverted V-shape. Accordingly, the first bar 152 includes two angularly spaced arms 154 which project downwardly with an angle 156 of approximately 25° therebetween from an apex 158. Projecting outwardly from the apex 158 of the first bar 152 is a second intersecting bar or member 160. The second bar 160 intersects the plane of the downwardly projecting arms 154 of the first bar 152 at an angle of approximately 95°. Accordingly, it should be noted that the downwardly projecting arms 154 of the first bar 152 are angled outwardly at an angle 162 of approximately 5° relative to a plane perpendicular to the floor or ground surface 182.

Formed in proximity to the ends of the first bar 152 and in proximity to the distal end of the second bar 160 are apertures 164 which, as will be explained later, are used to removably connect the cross bar 170 and the elongated leg columns 176 to the corner braces 150.

The first bar 152 is connected to the second intersecting bar 160 by a generally semicircular plate or cap 166 which is rolled over the second bar 160 and secured to the second bar 160 and the apex 158 and the arms 154 of the first bar 152 by welding or other conventional means. Secured between the arms 154 of the first bar 152 in the angle 156 is a triangular plate 168 to provide additional strength to arms 154.

The cross bar 170 is a galvanized steel pipe having two hollow ends which are sleeved over the second bars 160 of the two corner braces 150. For a double-seat swing 10, the cross bar will have a length of fifty-six inches, and for a single-seat swing 10′, the cross bar will have a length of thirty-two inches. The cross bar 170 also includes apertures located in proximity to its ends which, when the cross bar 170 is sleeved over the second bar 160 of the corner braces 150, coincide with the apertures 164 provided in the second bar 160. Importantly, the apertures formed in the cross bar 170 are provided a predetermined distance from the ends of the cross bar 170 so that when the cross bar is sleeved over the second bars 160 of the two corner braces 150 and the apertures coincide with the apertures 164 in the second bars 160, a space 174 is provided between the ends of the cross bar 170 and the caps 166 of the two corner braces 150. This space 174 provides a section for supporting the hooks 46 associated with the swing suspension assembly 40. The cross bar 170 is secured to the second bars 160 of the two corner braces 150 by pins 172 to prevent the second bars 160 from slipping out of the ends of the cross bar 170.

The elongated leg columns 176 each include a hollow end for sleeving the leg columns 176 over the downwardly projecting arms 154 of the corner braces 150. Each of the leg columns 176 also include apertures formed in the hollow ends which coincide with the apertures 164 provided in the arms 154 of the corner braces 150 when the leg columns 176 are sleeved over the arms 154. When the apertures coincide, a pin 178 is inserted therethrough to secure the leg columns 176 to the arms 154 to prevent them from accidentally being removed. The other ends of the leg columns 176 include base members 180 which, for example, may include rubber caps or base boards to prevent the support stand 12 from slipping on the floor or ground surface 182 or from sinking into the ground surface 182.

What is claimed is:

1. A swing, comprising a frame, a seat assembly including a sling forming at least one seat well and seat back, first and second elongated bars connected to opposed sides of the sling for engaging the frame, the frame including two elongated side members for supporting the sling therebetween, means for variably positioning each of the first and second elongated bars in at least two different positions relative to the ends of the side members to vary the depth of the seat well and the length of the seat back, the position of the first bar determining the depth of the seat well and the position of the second bar determining the length of the seat back, and suspension means for pivotally supporting the frame from an overhead support structure and for adjusting the inclination of the frame to recline the seat assembly, the suspension means including a pair of support strands connected to the frame on both sides of the seat assembly, a pair of pulleys each rotatably receiving one of the strands to allow movement of the strands, and adjustment blocks movably carried on each strand for establishing strand lengths between the pulleys and the frame to raise and lower portions of the frame and maintain a desired angle of inclination thereof.

2. The swing as recited in claim 1, further comprising at least one armrest, means for pivotally connecting the armrest to one of the frame side members, and means for adjusting the elevation and angle of inclination of the armrest relative to the seat assembly.

3. The swing as recited in claim 2 wherein the armrest includes an arcuate section having a shape generally the same as the seat well cross-sectional contour to thereby provide a side panel to the seat well.

4. The swing as recited in claim 3, further comprising a table surface including support means for removably and movably engaging the arm rest.

5. The swing as recited in claim 4 wherein the table surface support means includes a channel for frictionally engaging the top of the armrest to allow the table surface to be slidably moved away from and toward the seat assembly along the armrest.

6. The swing as recited in claim 5, further comprising a footrest and means for connecting the footrest to the frame side members, the footrest includes two side support members extending downwardly from the frame side members and a third elongated bar removably engaging the side support members.

7. The swing as recited in claim 6 wherein each of the footrest side support members includes a longitudinally extending slot for engaging the ends of the first elongated bar when positioned in either of its two different positions and means for variably positioning the third elongated bar in a plurality of positions along the support members relative to the seat assembly.

8. The swing as recited in claim 1, further comprising a canopy assembly and means for removably attaching the sides of the canopy assembly to the adjustment blocks carried on the support strands to suspend the canopy assembly above the seat assembly.

9. The swing as recited in claim 8 wherein the canopy assembly includes a front section and a rear section and two side support members, the front section includes means formed at its corners for engaging ends of the side support members to support the front section, and the rear section includes means formed in spaced relationship to its corners for engaging the other ends of the side support members and the support strands to support the rear section and form a movable rear wind flap.

10. The swing as recited in claim 9 wherein each of the adjustment blocks is circular and includes two radially positioned upper apertures and two radially positioned lower apertures for threading the support strands therethrough and a central aperture having a generally keyhole shape for receiving and retaining knotted ties attached to sides of the canopy assembly.

11. The swing as recited in claim 10 wherein the two lower apertures are spaced further apart than the two upper apertures.

12. A swing, comprising an overhead support stand which includes two corner braces, a removable cross bar sleeved onto each of the corner braces, and two removable legs sleeved onto and angularly extending from each of the corner braces, each of the corner braces includes a first member having an inverted V-shape and having two arms extending angularly from an apex for engaging the two removable legs, a second member extending angularly from the apex of the first member for engaging the cross bar, and means for connecting the first member to the second member, a frame, a seat assembly including a sling forming a seat well and back, first and second elongated bars connected to opposed sides of the sling for engaging the frame, the frame including two elongated side members for supporting the sling therebetween and means for variably positioning each of the first and second elongated bars in at least two different positions relative to the ends of the side members to vary the depth of the seat well and the length of the seat back, the position of the first bar determining the depth of the seat well and the position of the second bar determining the length of the seat back, and suspension means for pivotally supporting the frame from the second member of the corner braces of the overhead support stand and adjustably reclining the seat assembly, the suspension means including a pair of support strands connected to the frame on both sides of the seat assembly, a pair of pulleys coupled to the cross bar, each pulley receiving one of the strands, and adjustment means movably carried on each strand for establishing strand lengths between the pulleys and the frame to raise and lower portions of the frame and maintain a desired angle of inclination thereof.

13. The swing as recited in claim 12 wherein the means for connecting the first and second members of the corner braces includes a third member connected to a portion of the second member and connected to the apex and arms of the first member.

14. The swing as recited in claim 13 wherein the cross bar and second member of the corner braces include means for cooperatively limiting engagement therebetween to provide a section of the second member for supporting the suspension means for the frame.

15. A swing, comprising in combination a pair of side frame members, a sling forming at least one seat well and seat back, first suspension means for supporting the sling from the side frame members and for adjusting the depth of the seat well and the length of the seat back, the first suspension means including first and second elongated bars connected to opposed sides of the sling for engaging the frame, the frame including means for variably positioning each of the first and second elongated bars in at least two different positions relative to the ends of the side members, the position of the first bar determining the depth of the seat well and the position of the second bar determining the length of the seat back, and second suspension means for pivotally supporting the side frame members from an overhead support structure and for adjusting the inclination of the side frame members to recline the sling, the second suspension means including a pair of elongated support strands, each having its ends connected to one of the side frame members, a pair of pulleys for rotatably receiving the strands to allow movement of the strands, and means engaging the strands for adjusting the strand lengths from its ends to the pulleys to correspondingly raise and lower the ends of each side frame member and adjust the reclining position of the seat assembly.

* * * * *

UNITED STATES PATENT AND TRADEMARK OFFICE

CERTIFICATE OF CORRECTION

PATENT NO. : 4,351,524

DATED : September 28, 1982

INVENTOR(S) : Daniel Gomes

It is certified that error appears in the above-identified patent and that said Letters Patent is hereby corrected as shown below:

Column 4, line 26, "Either of" should be -- Each of --.

Signed and Sealed this

*Eleventh* Day of *January 1983*

[SEAL]

*Attest:*

GERALD J. MOSSINGHOFF

*Attesting Officer*

*Commissioner of Patents and Trademarks*